US005219375A

United States Patent [19]

Kamata et al.

[11] Patent Number: 5,219,375

[45] Date of Patent: Jun. 15, 1993

[54] RIVETER

[75] Inventors: Akira Kamata, Nara; Masaru Mori, Hyogo, both of Japan

[73] Assignees: Lobster Tool Co., Ltd., Osaka, Japan; Adolf Wuerth GmbH & Co. KG, Kuenzelsau, Fed. Rep. of Germany

[21] Appl. No.: 697,841

[22] Filed: May 9, 1991

[30] Foreign Application Priority Data

May 10, 1990 [JP] Japan ..... 2-121961
Dec. 19, 1990 [JP] Japan ..... 2-412262

[51] Int. Cl.[5] ..... B21J 15/34

[52] U.S. Cl. ..... 29/243.526; 29/26 B; 72/391.4

[58] Field of Search ..... 29/26 R, 26 A, 26 B, 29/243.521, 243.523, 243.526, 243.529, 34 B; 72/114, 391.4, 453.17

[56] References Cited

U.S. PATENT DOCUMENTS 3,028,987 4/1962 Van Hecke ..... 72/454 X
3,144,158 8/1964 Nouvelet ..... 29/243.521
3,423,986 1/1969 Young ..... 29/243.526
3,659,449 5/1972 Abernathy ..... 29/523 X
3,906,776 9/1976 Humphreys et al. ..... 29/525.1 X
4,063,443 12/1977 Yarborough ..... 29/243.526

FOREIGN PATENT DOCUMENTS 2417646 10/1974 Fed. Rep. of Germany ..... 29/243.521

*Primary Examiner*—Z. R. Bilinsky
*Attorney, Agent, or Firm*—Jordan and Hamburg

[57] ABSTRACT

The riveter of the invention comprises a shaft, a rolling nut, a jaw mechanism, a head frame, a rotary drive shaft, a clutch mechanism disengageably coupling the rolling nut with the rotary drive shaft, a generally cylindrical journal frame and a cylindrical main frame. After a blind rivet having a drill point is inserted into a nose piece of this riveter, the main frame and rotary drive shaft are rotated in a suitable manner, whereby the desired drilling of the rivet hole and riveting operation can be accomplished. The riveter may alternatively comprise a shaft, a rolling nut, a jaw mechanism, a head frame, a rotary drive shaft, a rear clutch mechanism disengageably coupling the rolling nut with the rotary drive shaft, a generally cylindrical journal frame, a cylindrical main frame, a front cover, a rear cover and a forward clutch mechanism.

6 Claims, 21 Drawing Sheets

RIVETER

BACKGROUND OF THE INVENTION

1. Technical Field

The present invention relates to improvements in the riveters and more particularly to a riveter having a drill function for drilling a hole for accepting a blind rivet in a plate member to be fastened with the rivet.

2. Prior Art

The conventional riveters, inclusive of the electrically driven riveter, air riveter and hand riveter and irrespective of the intricacy or simplicity of the mechanism or the difficulty or ease of handling, are so designed that a rivet hole is first drilled in a substrate plate by means of an electric drill or the like and, then, the blind rivet carried by the riveter is fed into the hole and driven to achieve the required fastening job.

Thus, the riveting operation with the conventional riveter involves two operations requiring two kinds of tools, namely the previous drilling of a plate with an electric or other drill and the riveting work proper using a riveter. As such, the riveting operation is necessarily poor in workability and this lack of efficiency is particularly serious in riveting operations at heights where no secure footfolds are available and the worker may inadvertently drop the tool during tool change to cause an accident.

SUMMARY OF THE INVENTION

Having been developed to overcome the above-mentioned disadvantages of the prior art riveters, the present invention has as its object to provide a riveter offering the convenience that both the drilling of the substrate plate and the delivery of a rivet can be continuously carried out with a single tool.

To accomplish the above object, the present invention provides a first type of riveter which comprises a shaft connected to a jaw mechanism at its forward end and having a rear threaded rod portion, said shaft being pierced by a turn-stop pin disposed across its axis in an appropriate intermediate position thereof and both ends of said pin protruding out of said shaft, a rolling nut threaded onto a rear end portion of said shaft, a clutch mechanism disengageably coupling said rolling nut with a rotary drive shaft, a generally cylindrical journal frame fitted over said shaft and having two juxtaposed axially elongated slots for accepting said protruding ends of the turn-stop pin on the shaft, and a cylindrical main frame fitted over and rigidly secured to said journal frame, with its forward portion covering a head frame housing a jaw mechanism, said rotary drive shaft having a bottomed cavity of required depth at its forward portion for permitting retraction of the shaft and disengaging of the clutch mechanism.

In the above riveter, the clutch mechanism may comprise a clutch integrally formed on a forward end face of the rotary drive shaft and an axially movable clutch disposed on a rear face of the rolling nut.

It may also be so arranged that a motor capable of rotation in normal and reverse directions is employed to drive said rotary drive shaft.

With the riveter of the above construction being in a condition such that the jaw of the jaw mechanism remains open, a blind rivet carrying a drill point at its forward end is inserted into the jaw and the main frame is manually turned clockwise as viewed from the nose piece through a necessary angle, whereby the rotation of the main frame is transmitted through the journal frame and the turn-stop pin to the shaft to turn the latter in the same direction and retract it via the rolling nut and the slots formed in the journal frame. As a result, the blind rivet is held firmly in position by the jaw.

This rivet-gripping operation can also be performed, with the operator holding the main frame stationary against rotating by hand, by driving the rotary drive shaft in the normal direction with said motor to thereby rotate the rolling nut via the clutch mechanism and retract the shaft.

Then, the drill point of the blind rivet gripped by the jaw is applied against a plate member to be riveted and the rotary drive shaft is turned in the normal direction, whereupon the plate member is drilled by the drill point and the blind rivet delivered into the drilled hole.

In this state, with the main frame being held against rotation by hand, the rotary drive shaft is driven in the normal direction, whereby the shaft is retracted by the necessary amount via the above-described transmission means to complete the riveting work.

After completion of the riveting work, the main frame is manually rotated counterclockwise as viewed from the nose piece or, with the main frame held against rotation by hand, the rotary drive shaft is rotated in the reverse direction with the motor. In either case, the shaft is driven forward through said transmission means to relieve the grip of the jaw on the break shaft of the blind rivet for ejection of the shaft.

The action of the clutch mechanism in the present invention is now described.

After the riveting work has been completed as described above, as the rotary drive shaft is further driven in the normal direction with the main frame held stationary, the shaft retracts further until its rear end hits the steel ball fitted in the depth of the bottomed cavity of the rotary drive shaft to cause the shaft to retreat. Thereupon, a gap is formed between the clutch on the side of the rotary drive shaft and the movable clutch and the rolling nut to disengage the clutches from each other, with the result that the torque of the rotary drive shaft is no longer transmitted to the movable clutch and the rolling nut accordingly ceases to rotate, thus stopping the retracting motion of the shaft.

Now, when the two clutches are in the engageable position, the rotary drive shaft is rotated in the reverse direction with the main frame held stationary until the two clutches are engaged by meshing. Thereupon, the torque of the rotary drive shaft is transmitted to the rolling nut 2 to advance the shaft until it regains its initial position, thus completing one cycle of riveting.

In blind riveting with the above riveter, unlike with the conventional various riveters, it is not necessary to perform two sequential operations, namely drilling of a substrate plate with a drill and subsequent riveting work but the whole drilling job can be accomplished continuously with this riveter alone. therefore, the riveter is very economical and efficient and insures safety of riveting at heights. Moreover, since the riveter of the invention is an attachment type device which can utilize the reversible motor of an existing electric drill or the like tool when it is mounted on the tool, it can be manufactured and supplied at still lower cost.

The second type of riveter provided by the present invention comprises a shaft connected to a jaw mechanism at its forward end and having a rear threaded rod portion, said shaft being pierced by turn-stop pin across its axis in an appropriate intermediate position, with both ends of said turn-stop pin protruding beyond said shaft, a rolling nut threaded on a rear end portion of said shaft, a rear clutch mechanism disengageably coupling said rolling nut with said rotary drive shaft, a generally cylindrical journal frame fitted over said shaft and having two juxtaposed axially elongated slots for accepting said protruding ends of said turn-stop pin, and a cylindrical main frame fitted over said journal frame through interposition of said forward clutch mechanism, said forward clutch mechanism comprising a forward clutch having two axially elongated slots disposed in registry with said two juxtaposed slots formed in said journal frame and rearwardly biased by a spring means and a rear clutch fitted rigidly to said main frame for rotation as a unit, said rotary drive shaft having a buttomed cavity of necessary depth at its forward part for enabling retraction of the rotary drive shaft and disengaging of the rear clutch mechanism, and the engaging or disengaging of said forward clutch and rear clutch of the forward clutch mechanism being effected by the normal or reverse rotation of said rotary drive shaft.

Furthermore, in the riveter of the above construction, the rear clutch mechanism may comprises a clutch integrally formed on a forward end face of the rotary drive shaft and an axially movable clutch disposed on a rear face of the rolling nut.

Moreover, the rear clutch of the forward clutch mechanism may be so constructed that it is forwardly pre-energized, either directly or indirectly, by a spring means directly or indirectly disposed rearwardly thereof.

When the above riveter is in the condition wherein the jaw of the jaw mechanism is open, a blind rivet having a drill point at its tip is inserted into said jaw and with the main frame being held against rotation by hand (whereby the rear clutch of the forward clutch mechanism which is rigidly secured to the main frame is also held stationary), the rotary drive shaft is rotated slightly in the normal direction with the motor to thereby turn the rolling nut in the normal direction via the rear clutch mechanism. Thereupon, the forward clutch and rear clutch of the forward clutch mechanism are brought into engagement to displace the shaft rearward via the slots formed in the journal frame and the turn-stop pin, whereby the blind rivet is gripped by the jaw.

This rivet gripping effect can also be accomplished as follows. Thus, as the main frame is manually turned through a necessary angle clockwise as viewed from the nose piece, the torque of the main frame is transmitted through the journal frame and turn-stop pin to the shaft and rotates it in the same direction to thereby drive the shaft rearward via the rolling nut and the slots formed in the journal frame.

Then, the operator relieves his hold on the main frame, applies the tip of the drill point of the blind rivet gripped by the jaw against the substrate plate to be riveted and rotates the rotary drive shaft in the normal direction, whereby the plate is drilled by the drill point and, at the same time, the blind rivet is fed into the drilled hole.

In this condition, with the main frame held against rotation by hand, the rotary drive shaft is turned in the normal direction. Since the forward clutch of the forward clutch mechanism and the rear clutch rigidly secured to the main frame are in engagement for setting the rivet, the rotation of the journal frame is prohibited. Therefore, the shaft is driven rearward through said transmission means to complete the riveting work.

After completion of riveting, the main frame is held stationary by hand to prevent its rotation and, in this condition, the rotary drive shaft is rotated in the reverse direction, whereupon the turn-stop pin advances to the forward end of the slots in the forward clutch. The pin then pushes the forward clutch forward against the spring $S_1$ biasing the forward clutch rearward to thereby disengage the forward clutch mechanism. As a result, all the members other than the main frame, rear clutch and rear cover are freed of restraint and become free to idle.

The broken rivet shaft is ejected the moment the gripping force of the jaw is released and immediately before the restraint on rotation by the turn-stop pin is released.

The action of the rear clutch mechanism is identical with that of the clutch mechanism in the first type of riveter described hereinbefore.

In addition to the effects accomplished by the first type of riveter, this second type of riveter offers the following advantages.

Since the engagement of the forward clutch mechanism is releasable on return of the jaw mechanism and shaft to their initial positions, these members as well as the rolling nut are rendered idling on return stroke so that even if the timing of stopping the motor driving the rotary drive shaft is delayed, the danger of providing a strong shock to the hands of the operator holding the main frame is effectively precluded for the reasons mentioned hereinbefore and the riveting operation can be repeated smoothly.

Furthermore, the forward clutch mechanism is so rugged in construction that the repeated engaging and disengaging of the front clutch and rear clutch does not easily result in damage to the clutch mechanism. Therefore, the riveter of the present invention can enjoy a by far longer serviceable life and, as an additional advantage, gives no chances for misassembling.

DETAILED DESCRIPTION OF THE PREFERRED EMBODIMENTS

Figure 1:
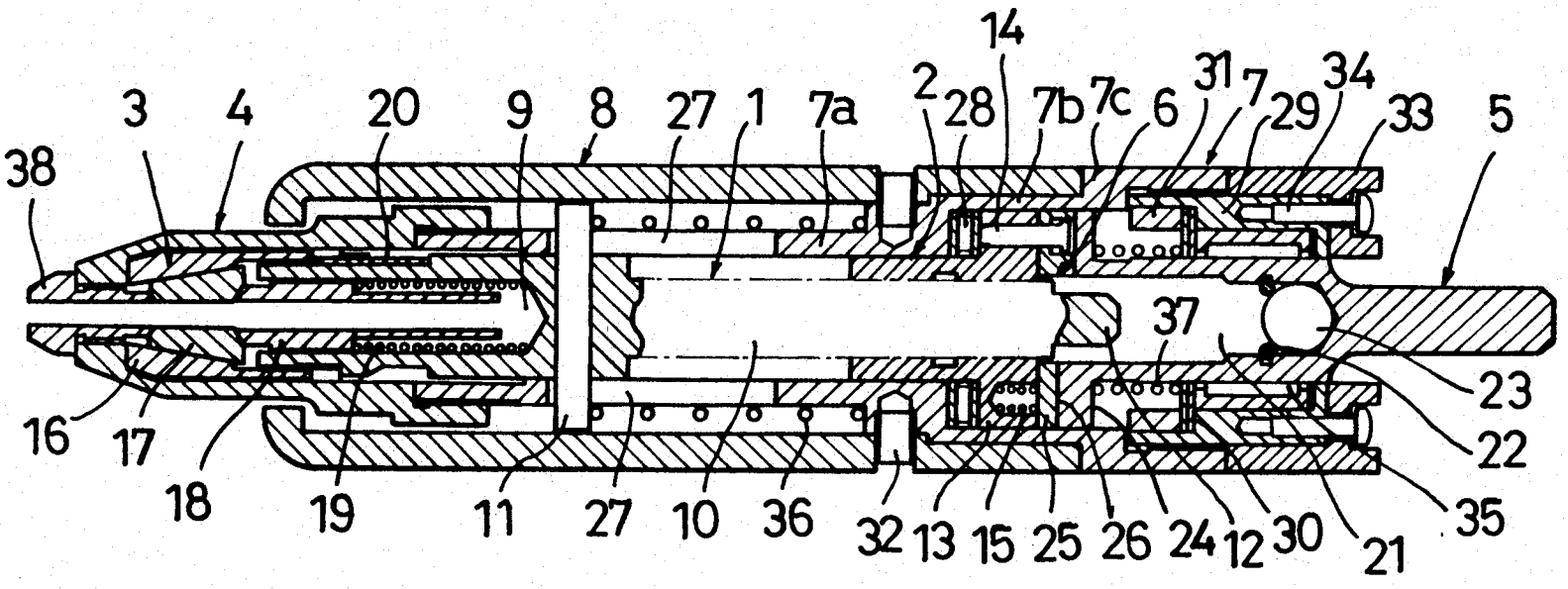
FIG. 1 is a front overall view, in longitudinal section, showing the first type of riveter according to the invention.

An electric riveter is now described with reference to the drawings showing an embodiment of the invention.

The electric riveter shown in FIGS. 1 through 7(A), (B) generally comprises a shaft 1, a rolling nut 2, a jaw mechanism 3, a head frame 4, a rotary drive shaft 5, a clutch mechanism 6 which disengageably couples said rolling nut 2 with said rotary drive shaft 5, a generally cylindrical journal frame 7 and a cylindrical main frame 8.

The shaft 1 mentioned above has a bottomed cavity 9 for accommodating a jaw member constituting part of said jaw mechanism 3 in its forward portion and a rear threaded rod portion 10, said shaft being pierced by a turn-stop pin 11 perpendicular to the axis thereof in a generally mid-position, with a push-rod 12 extending from the rear end of said shaft 1.

The rolling nut 2 is threaded onto the rear end portion of the threaded rod portion 10 of said shaft 1, the rear end part of said nut being formed with a flange 13 for accepting a connecting pin 14 which engages a movable clutch of the clutch mechanism 6, which is described hereinafter, in a manner to permit limited movement in the axial direction and a spring 15 biasing said movable clutch.

The jaw mechanism 3 comprises well-known jaw members, namely a jaw case 16, a jaw 17 housed therein, a jaw pusher 18 and a jaw pusher spring 19. Of these members, the jaw pusher 18 and the jaw pusher spring 19 are accommodated in the bottomed cavity 9 of said rotary shaft 1, while the jaw case 16 is secured to the peripheral tip of the shaft 1 via a turn-stop ring 20.

The head frame 4 is installed over the forward end of the jaw mechanism 3 and the shaft 1, with its rear end portion being fitted over the forward end portion of a journal frame 7 which is described hereinafter.

The rotary drive shaft 5 is formed with a bottomed cavity 21 of the required depth for enabling retraction of the shaft 1 in its forward part, and in this particular embodiment, a steel ball 23 is fitted in the bottom of said cavity via an O-ring 22 so that the push rod 12 of the shaft 1 on retraction is abutted against the steel ball 23 to cause the rotary drive shaft 5 to retreat and disengage the clutch mechanism 6. Moreover, the forward face of a flange 24 at the opening of said bottomed cavity 21 is integrally formed with the other clutch of the clutch mechanism 6 which is described below.

The clutch mechanism 6 comprises a movable clutch 25 which is installed on the rearward face of the rear flange 13 of the rolling nut 2 via said connection pin 14 and biasing spring 15 in such a manner as to permit limited movement in the axial direction and a drive shaft clutch 26 integrally formed on the forward face of said flange 24 disposed at the opening of the bottomed cavity 21 of the rotary drive shaft 5 and disengageably engaging said movable clutch 25.

The journal frame 7 is a generally cylindrical member comprising a reduced-diameter segment 7*a* forming a forward half thereof, an intermediate-diameter segment 7*b* forming an intermediate part thereof, and a large-diameter segment 7*c* forming a rearward part thereof, and the reduced-diameter segment 7*a* is provided with a couple of axially elongated slots 27,27 in upper and lower positions as viewed in FIG. 1. After this reduced-diameter segment 7*a* of the frame is fitted over said shaft 1, projecting ends 11*a*, 11*a* of the turn-stop pin 11 for the shaft 1 are inserted into said slots 27,27, respectively, and the forward end portion of the reduced-diameter frame segment 7*a* is fitted over the rearward end portion of the head frame 4, with its rearward end portion being fitted over a reduced-diameter part of the rolling nut 2.

Disposed within the intermediate-diameter frame portion 7*b* are a thrust bearing 28, the rear-end flange 13 of rolling nut 2, and the clutch mechanism 6, while the forward half of the rotary drive shaft 29, an orbit ring 30 and a spacer 31 are disposed inwardly of said large-diameter frame segment 7*c*.

Figure 2:
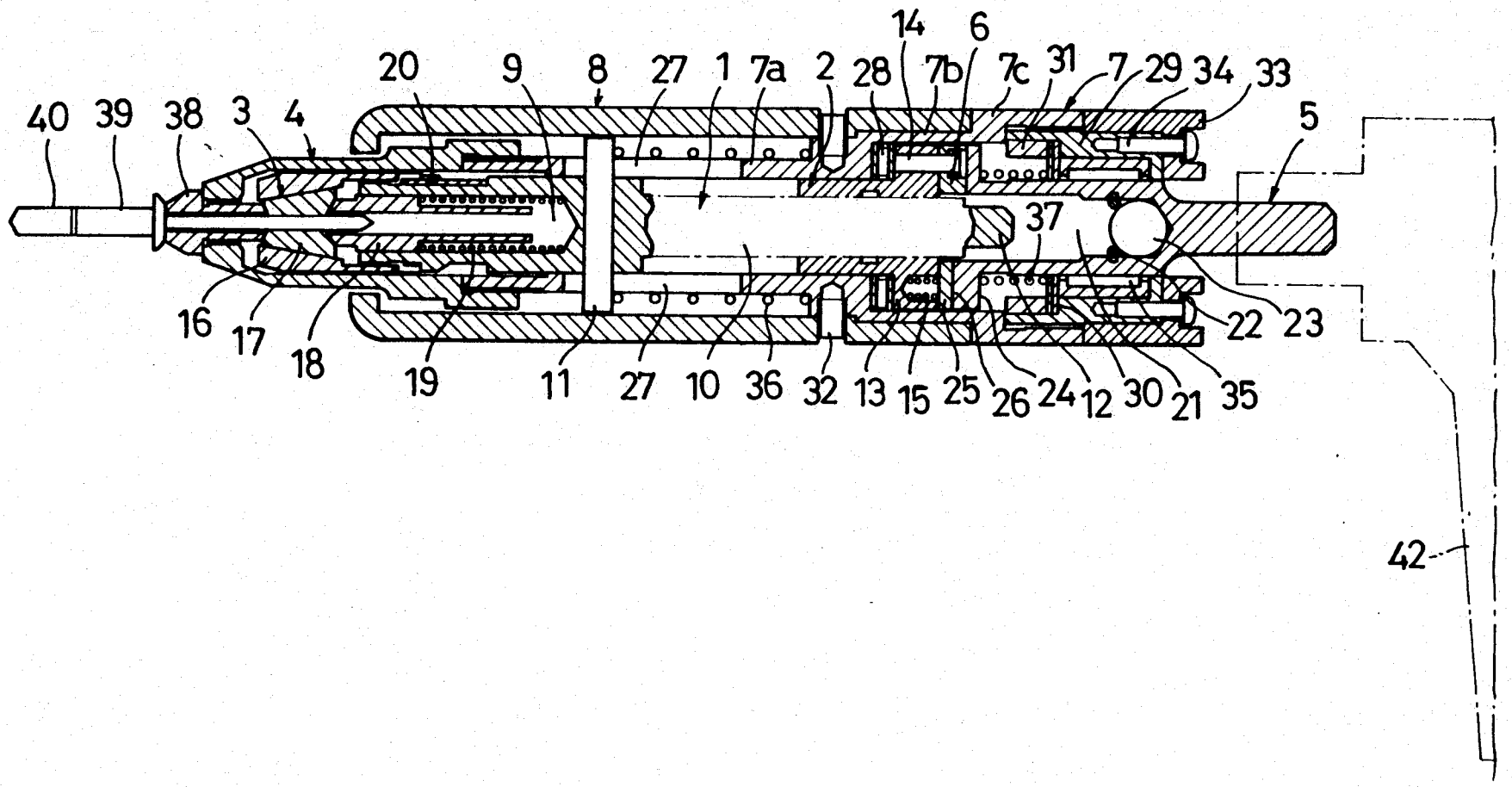
FIG. 2 is a front view, in longitudinal section, showing the same riveter holding a blind rivet.
Figure 3:
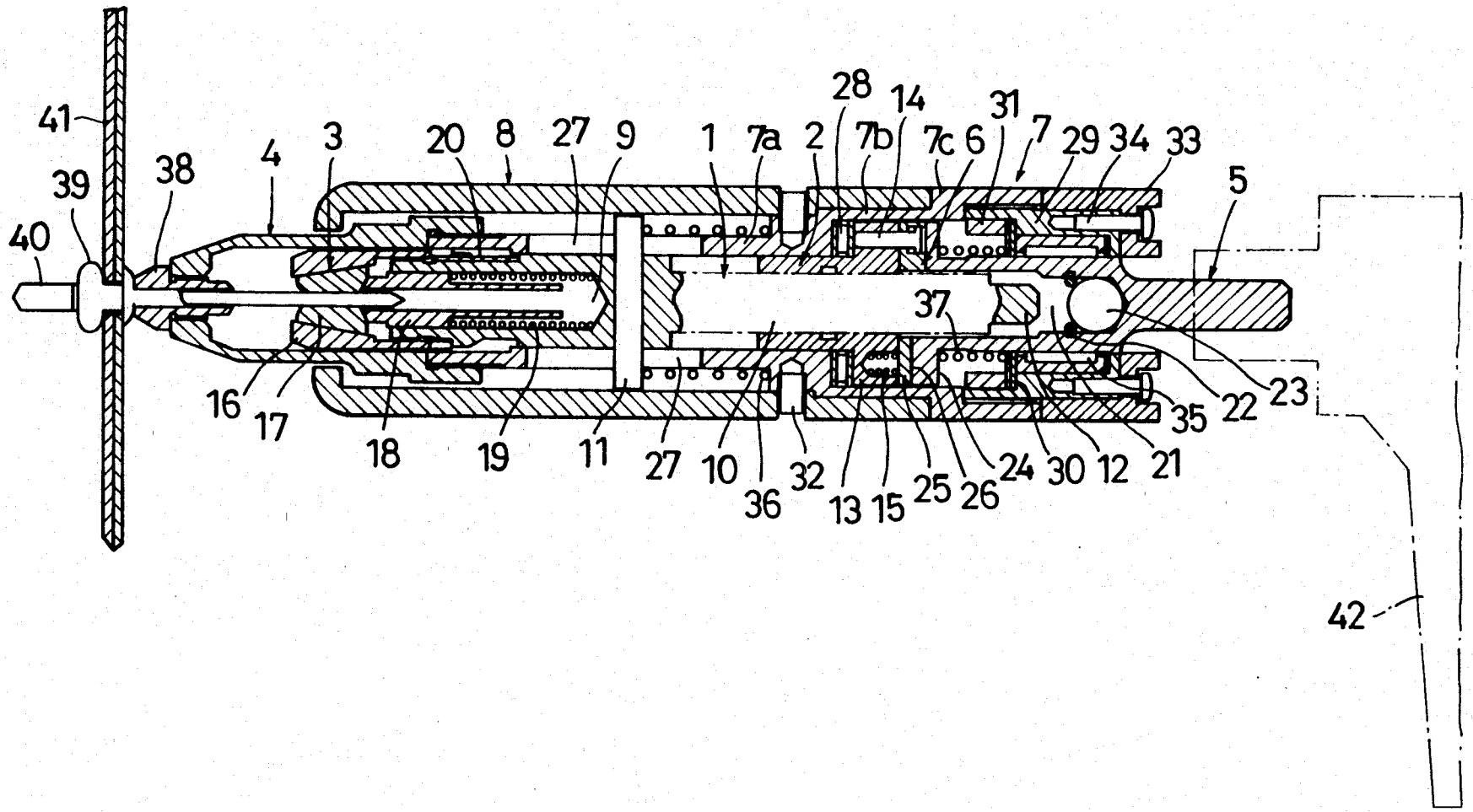
FIG. 3 is a front view, in longitudinal section, showing the same riveter on completion of riveting work.

The main frame 8 is a cylindrical member having an outer diameter equal to the center diameter of the large-diameter segment 7*c* of said journal frame 7 and, with its rear end portion being abutted against the step between the intermediate-diameter frame segment 7*b* and the large-diameter frame segment 7*c*, the members from the intermediate-diameter frame segment 7*b* to the rearward half portion of the head frame 4 are set in position and, in this embodiment, the main frame 8 is rigidly secured to the journal frame 7 with a stop screw 32 in the thick-walled position of the intermediate diameter segment 7*b* of the journal frame 7 to thereby constitute a riveter. Referring to FIGS. 1 through 3, reference numeral 33 indicates a rear frame fitted over the rearward half portion of a power bearing 29, 34 a stop screw thereof, 35 a needle bearing, 36 a shaft spring biased between the rear step of the reduced-diameter segment 7*a* of the journal frame 7 and the turn-stop pin 11, 37 a power bearing spring, 38 a nose piece, 39 a blind rivet integrally carrying a drill point 40 at its forward end, 41 a substrate plate to be riveted, and 42 a grip handle housing a reversible drive motor disconnectably connected to the rotary drive shaft 5 and a switch mechanism (not shown).

With the riveter of the above construction being in a condition such that the jaw 17 of the jaw mechanism 3 remains open as illustrated in FIG. 1, a blind rivet 39 carrying a drill point 40 at its forward end is fed into the jaw and the main frame 8 is manually turned clockwise as viewed from the nose piece 38 through a necessary angle, whereby the rotation of the main frame 8 is transmitted through the journal frame 7 and turn-stop pin 11 to the shaft 1 to turn the latter in the same direction and retract it via the rolling nut 2 and the slots 27,27 formed in the journal frame 7. As a result, the blind rivet 39 is held firmly in position by the jaw 17 as illustrated in FIG. 2.

This rivet-gripping operation can also be performed, with the main frame 8 held against rotation by hand, by the rotary drive shaft 5 in the normal direction with the motor to thereby rotate the rolling nut 6 via clutch mechanism 6 and retract the shaft 1.

Then, the drill point 40 of the blind rivet 39 gripped by the jaw 17 is applied against a plate member 41 to be riveted and the rotary drive shaft 5 is turned in the normal direction, whereupon the plate member 41 is drilled by the drill point 40 and the blind rivet 39 delivered into the drilled hole (not shown). In this state, with the main frame 8 being held against rotation by hand, the rotary drive shaft 5 is driven in the normal direction, whereupon the shaft 1 is retracted by the necessary amount via the above-described transmission means as illustrated in FIG. 3 to complete the riveting work.

After completion of the riveting work, the main frame 8 is manually rotated counterclockwise as viewed from the noise piece 38 or, with the main frame 8 held against rotation by hand, the rotary drive shaft 5 is rotated in the reverse direction with the motor. In either case, the shaft 1 is driven forward through said transmission means to relieve the grip of the jaw 17 on the break shaft of the blind rivet for ejection of the shaft.

The action of the clutch mechanism 6 in the present invention is now described.

Figure 4A:
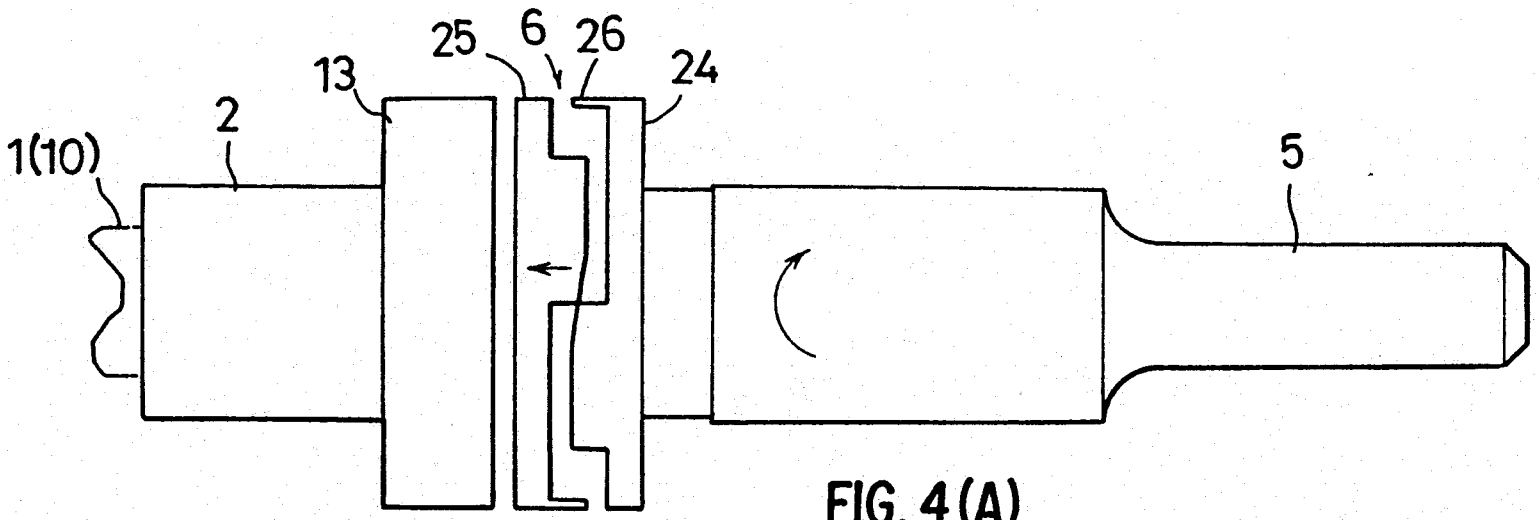
FIGS. 4(A), (B) through FIGS. 6(A), (B) illustrate the action of the clutch mechanism and are the front views and cross-section views of main parts showing the disengagement of two clutches of the clutch mechanism in a series of stages.
Figure 4B:
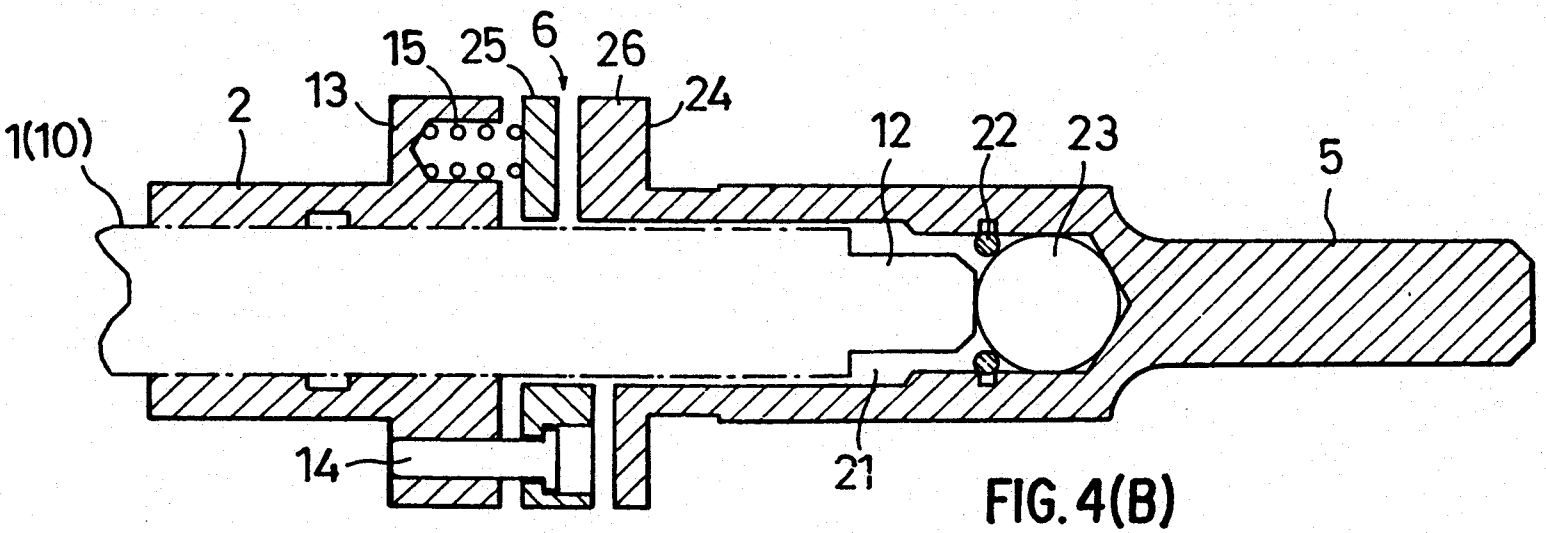
Figure 5A:
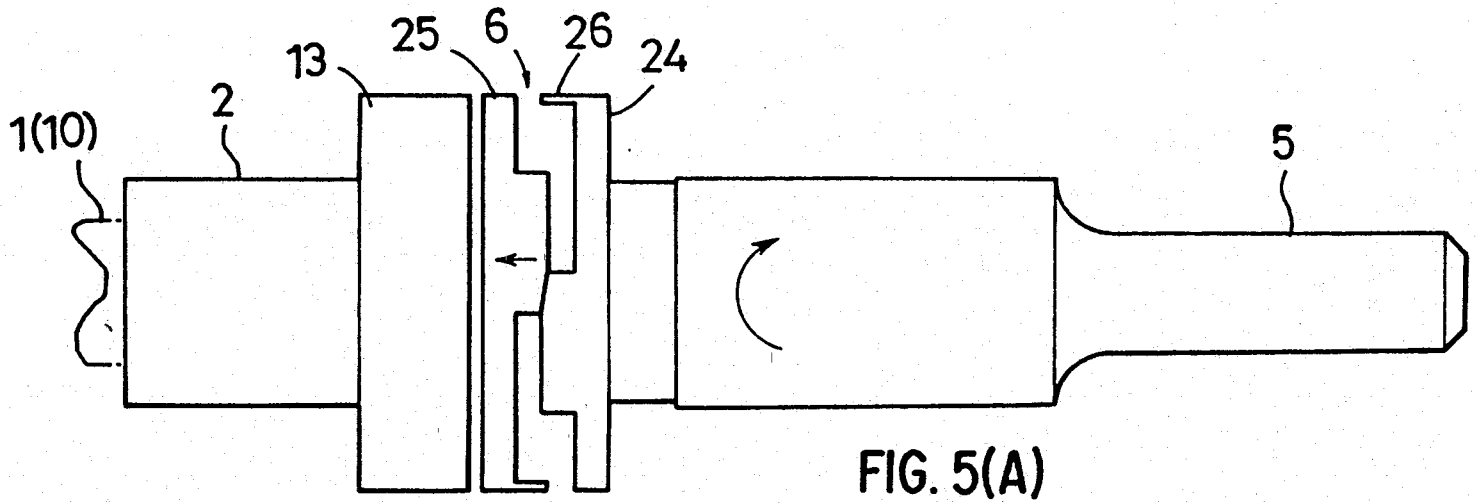
Figure 5B:
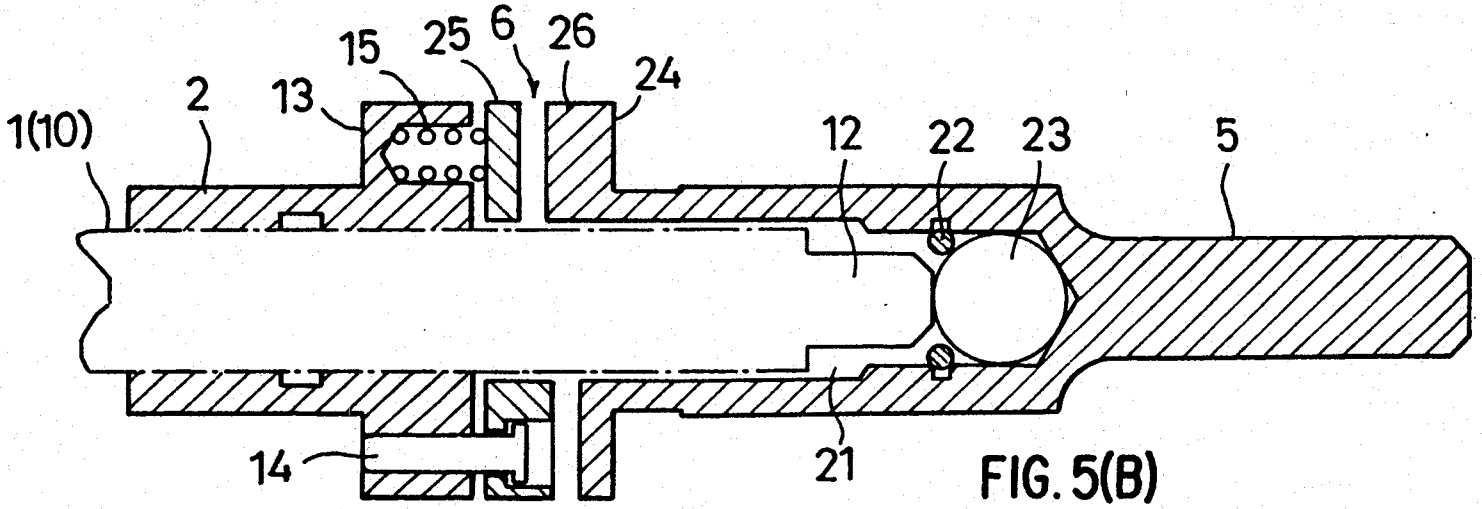
Figure 6A:
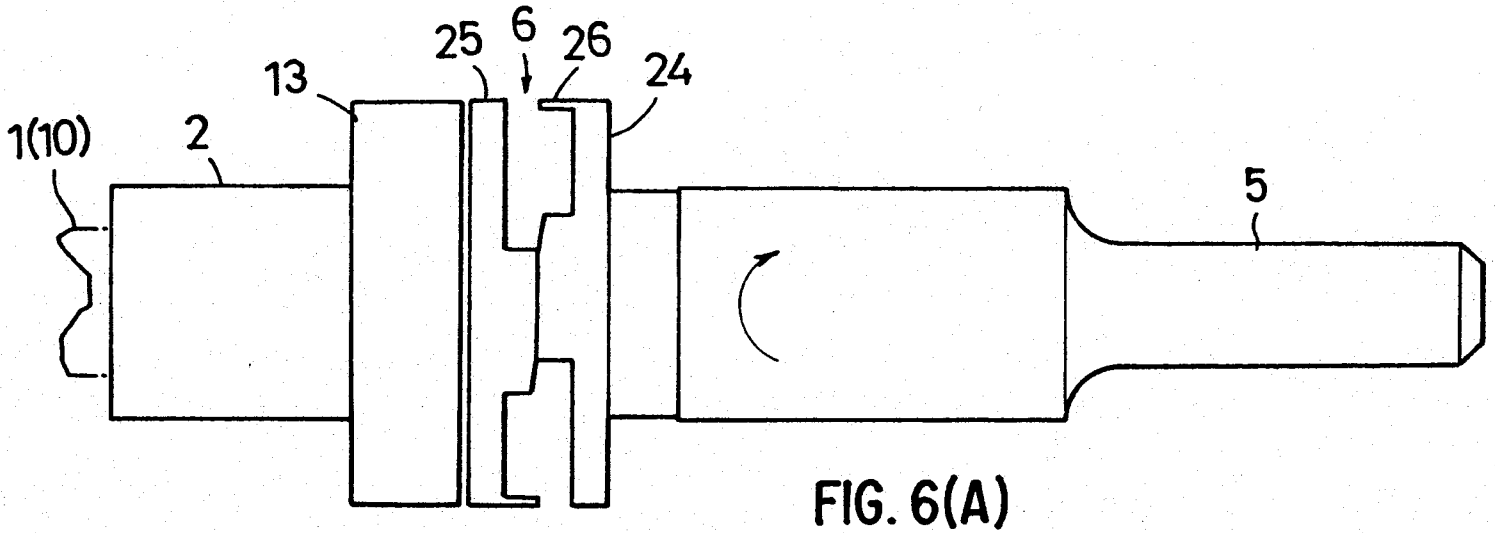
Figure 6B:
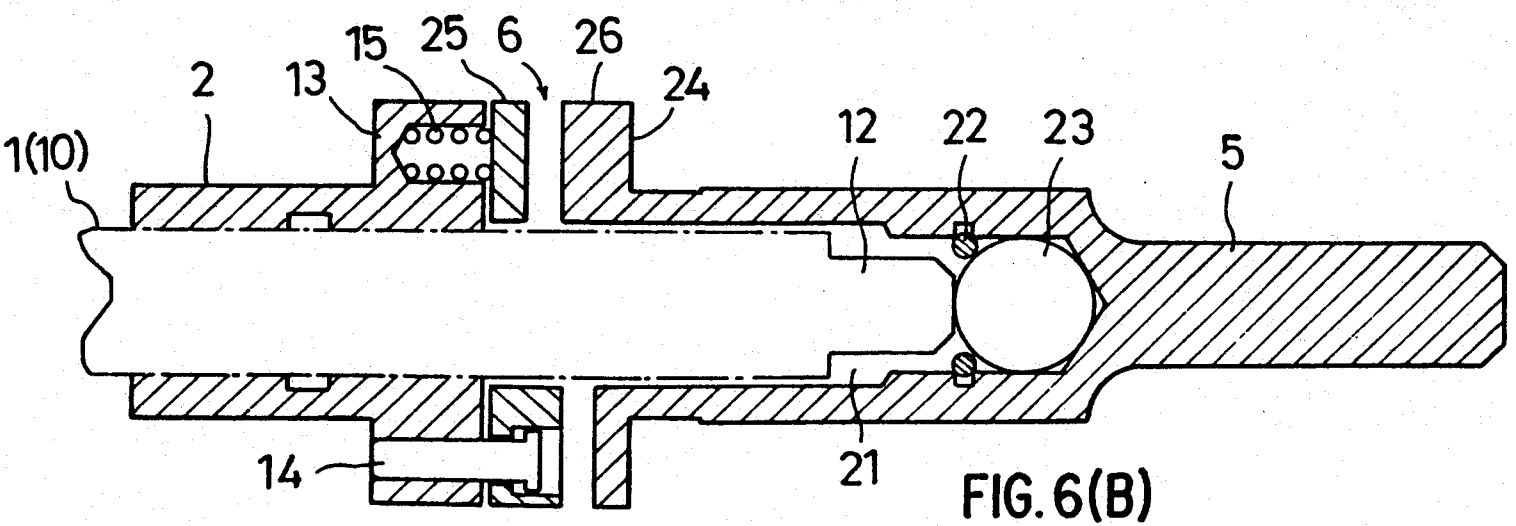
Figure 7A:
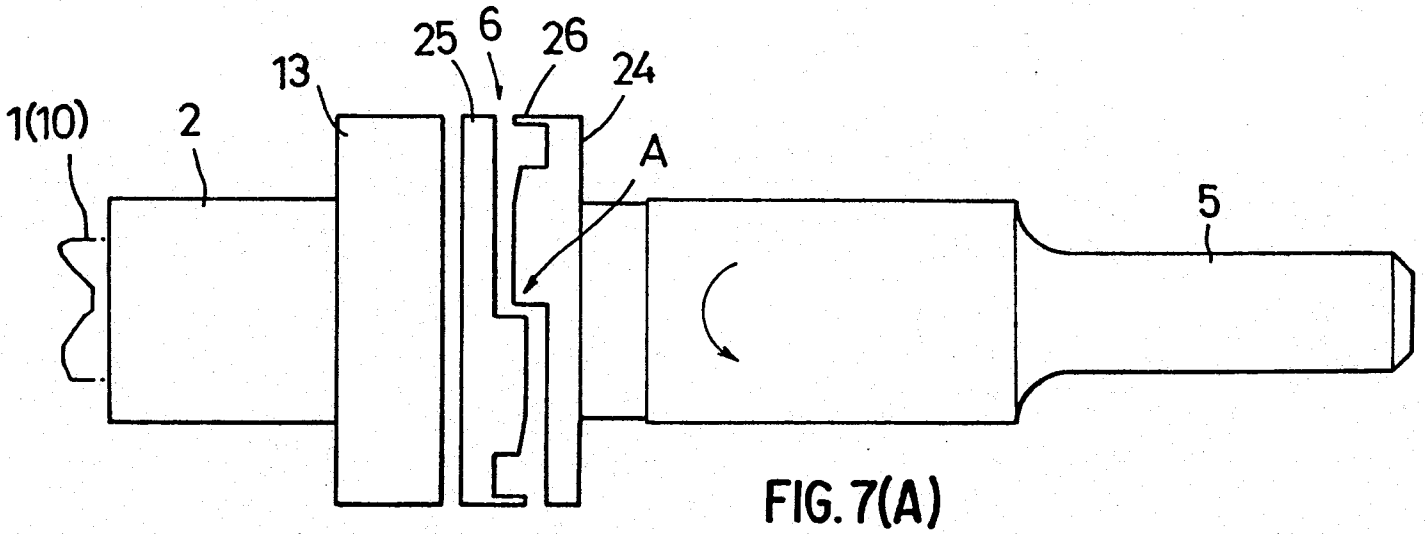
FIGS. 7(A), (B) illustrate the action of the clutch mechanism and are a front view and a cross-section view, respectively, of main parts showing the reengagement of the two clutches constituting the clutch mechanism.
Figure 7B:
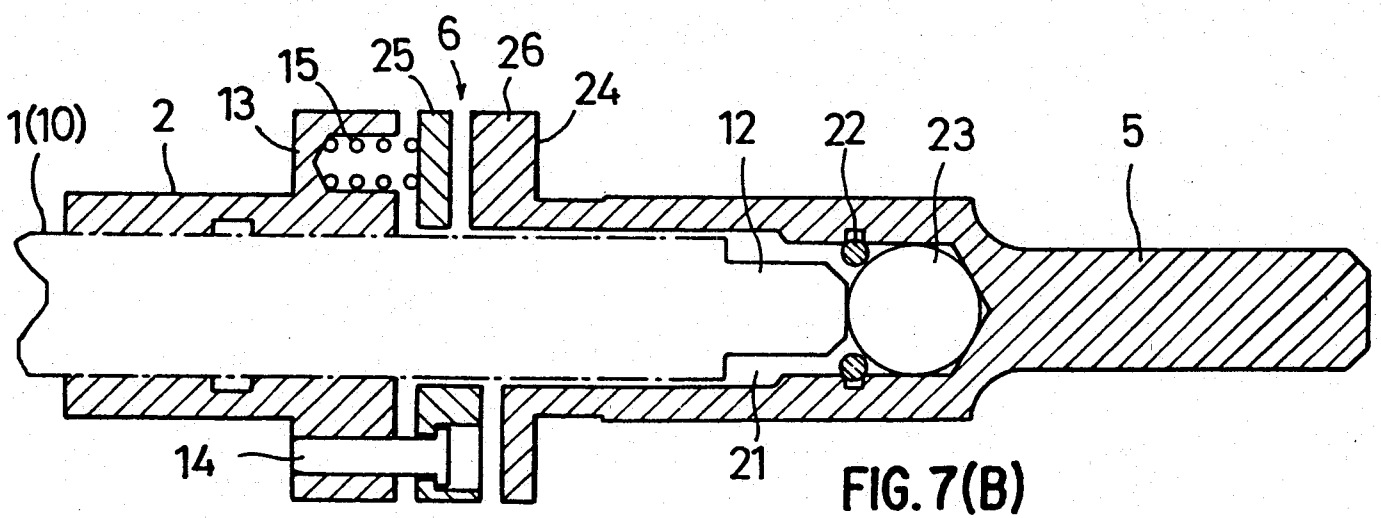

After the riveting work has been completed as described above, as rotary drive shaft 5 is further driven in the normal direction with the main frame 8 held stationary, the shaft 1 retracts further from the position indicated in FIG. 3 until its rear end hits the steel ball 23 fitted in the depth of the bottomed cavity 21 of the rotary drive shaft 5 to cause the shaft 5 to retreat. Thereupon, as shown in FIGS. 4(A), (B) through 6(A), (B) (particularly in FIGS. 4(A), (B), a gap is formed between the clutch 26 on the side of the rotary drive shaft 5 and the movable clutch 25 and the rolling nut 2 to disengage the clutches 25,26 from each other, with the result that the torque of the rotary drive shaft 5 is no longer transmitted to the movable clutch 25 and the rolling nut accordingly ceases to rotate, thus stopping the retracting motion of the shaft 1. Now, when the two clutches 25,26 are in the position shown in FIGS. 7(A), (B) the rotary drive shaft 5 is rotated in the reverse direction with the main frame 8 held stationary until the two clutches 25,26 are engaged by meshing at A. Thereupon, the torque of the rotary drive shaft 5 is transmitted to the rolling nut 2 to advance the shaft 1 to the left as shown until it regains its initial position indicated in FIG. 1, thus completing one cycle of riveting.

This electric riveter can be actuated by the above procedure to effect the desired drilling and riveting operations with a single tool, thus enabling the riveting work with remarkably high efficiency and economically.

FIGS. 8 through 21 shows an electric riveter according to another embodiment of the invention. In these several views, the parts corresponding to those of the first embodiment are designated by the numerals obtained by adding 100 to the respective numerals assigned to the parts of the first embodiment.

This electric riveter generally comprises a shaft 101, a rolling nut 102, a jaw mechanism 103, a head frame 104, a rotary drive shaft 105, a rear clutch mechanism 106 disengageably coupling said rolling nut 102 with said rotary drive shaft 105, a generally cylindrical journal frame 107, a cylindrical main frame 108, a front cover 159, a rear cover 150, and a forward clutch mechanism 151.

The shaft 101 in this embodiment is generally similar in construction to the shaft 1 in the first embodiment. The rolling nut 102, jaw mechanism 103, head frame 104 and rotary drive shaft 105 in this embodiment are also identical in construction with the corresponding parts in the first embodiment. And, the flange 113 at the rear end of the rolling nut 102 is operatively associated with the rear clutch mechanism 106. Moreover, the forward face of a flange 124 of the rotary drive shaft 105 is integrally formed with the other clutch of the rear clutch mechanism 106. The rear clutch mechanism 106 is structurally identical with the clutch mechanism 6 in the first embodiment. Disposed inwardly of the intermediate-diameter segment **107*b* of the journal frame 107 is the rear clutch mechanism 106 together with a thrust bearing 128 and a rolling nut 102**.

The main frame 108 is a cylindrical member covering said journal frame 107 over the large-diameter segment **107*c* through the intermediate-diameter segment 107*b* to the rear half portion of the reduced-diameter segment 107*a*, and the front cover 159 is fitted from the side on which the head frame 104 is located, with its base being threaded onto the forward end portion of the main frame 108. The rear cover 150 is fitted from the rear end of the rotary drive shaft 105, with its forward end portion being threaded onto the rear end portion of the main frame 108**.

The forward clutch mechanism 151 comprises a cylindrical forward clutch 165 and a cylindrical rear clutch 166 both fitted over the reduced-diameter segment **107*a* of the rotary drive shaft frame 107 and said forward clutch 165 is equipped with an engaging serration 165*a* at its rear end and a couple of axially elongated slots 165*b*, 165*b* in registry with the couple of slots 127, 127 formed in the rotary drive shaft 107. The projecting ends of the turn-stop pin 111 are fitted into these slots 165*b*, 165*b*, and with a returning spring $S_1$ based between the forward end face of said clutch 165 and the rear end portion of the head frame 104, the clutch 165 is normally pre-energized rearwardly. Moreover, the outer periphery of the clutch 165 is covered with the forward part of the main frame 108 and the rear part of the front cover 159**.

The rear clutch 166 mentioned above is equipped, as its forward end, with an engaging serration **166*a* engageable with the engaging serration 165*a* of said forward clutch 165. This clutch 166 is fitted into the main frame 108 so that it may rotate together with the main frame 108. With the forward clutch mechanism 151 thus constructed, the steps described hereinbefore are followed. The sequence of operation, thus, comprises gripping of a blind rivet 139 by the jaw 117, drilling of a substrate plate 141 by the drill point 140, riveting work, and disengaging of the clutch mechanism 151 that allows idle rotation of the members other than the front cover 159, main frame 108, the rear clutch 166 of the forward clutch mechanism 151 integral with the main frame 108, and the rear cover 150**.

Figure 9:
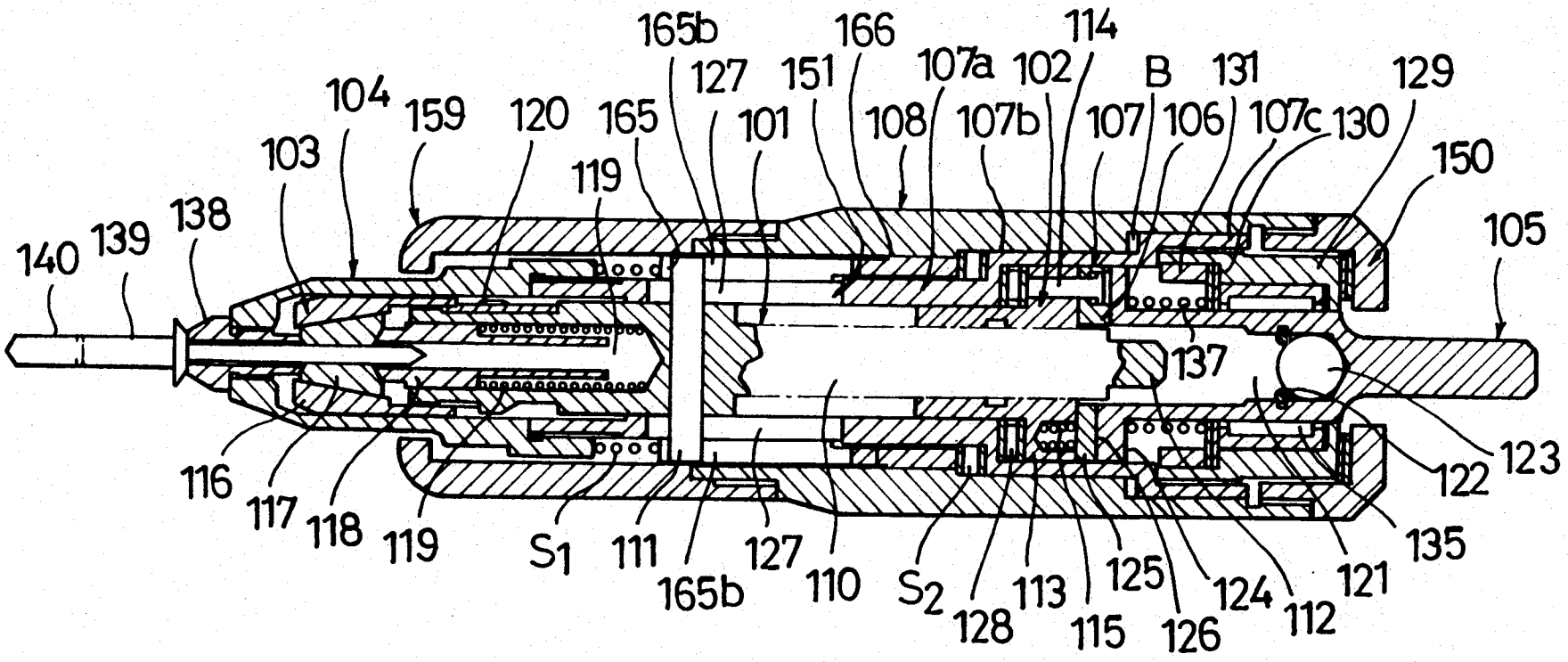
FIG. 9 is a front overall view, in longitudinal section, showing the same riveter holding a blind rivet.
Figure 10:
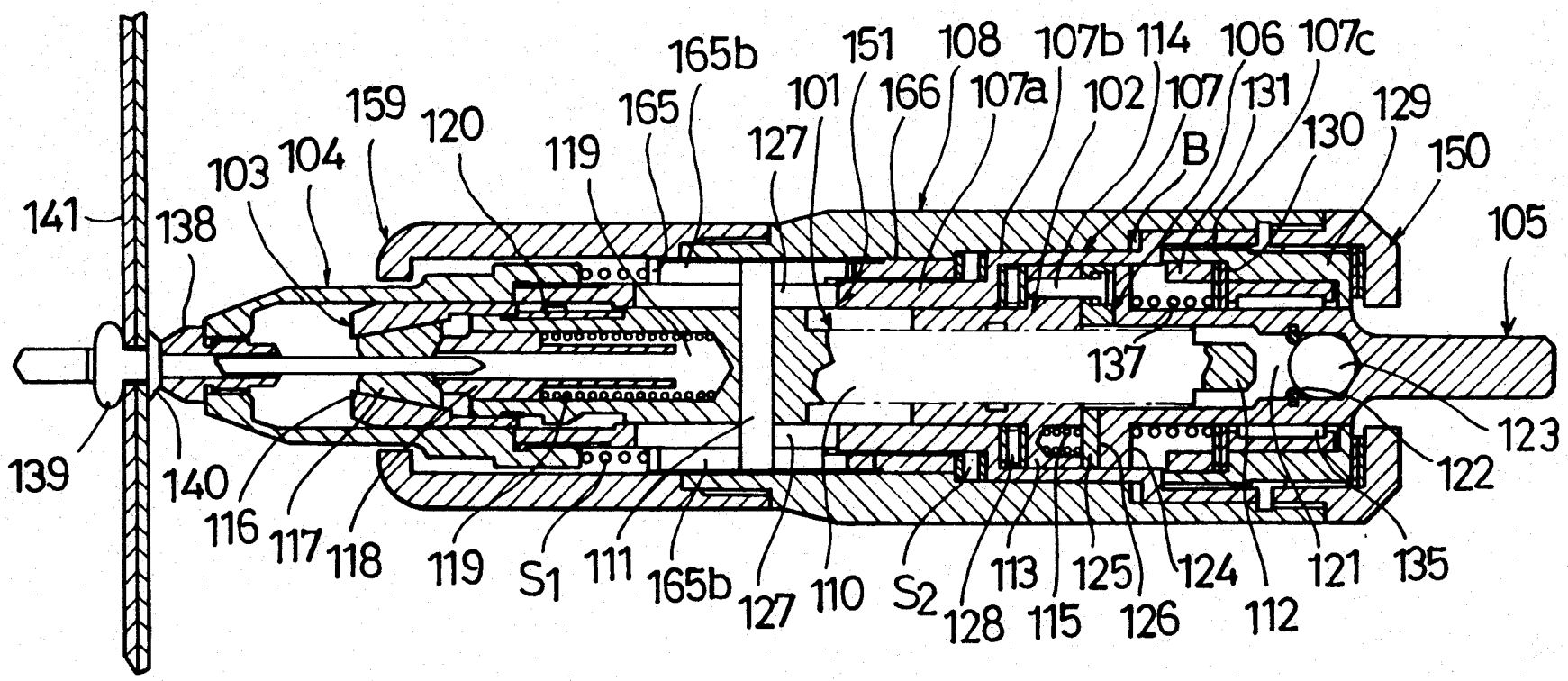
FIG. 10 is a front view, in longitudinal section, showing the same riveter in completion of riveting work.
Figure 11:
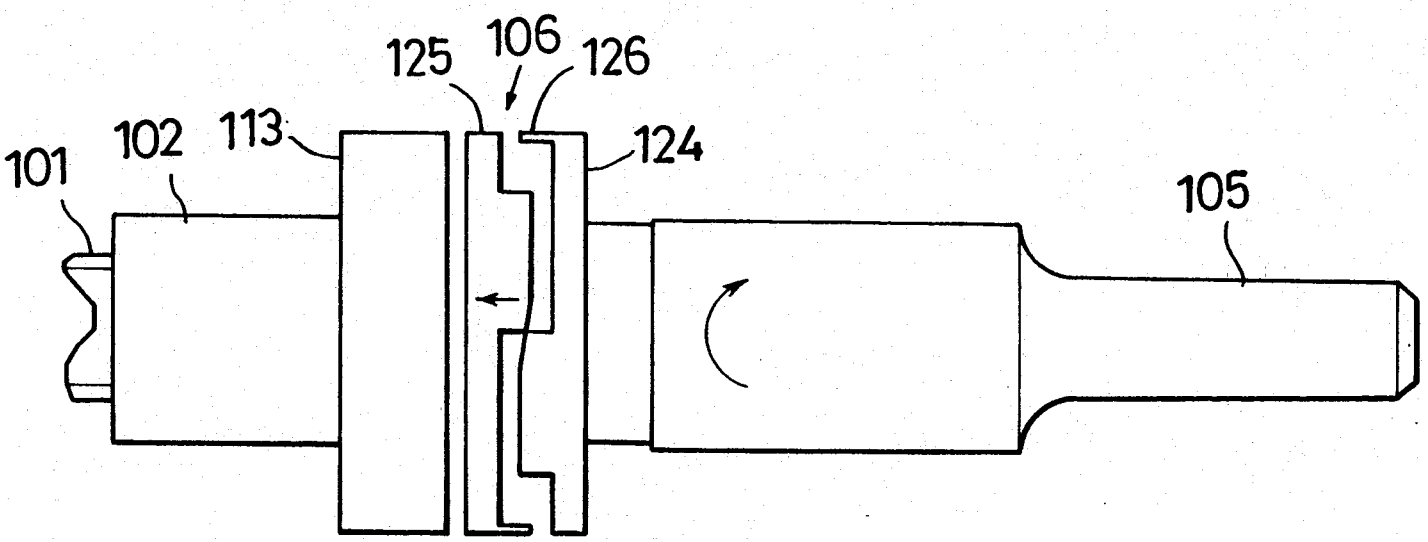
FIG. 11 is a front partial view of main parts showing the beginning of disengagement of the rear clutch mechanism.
Figure 12:
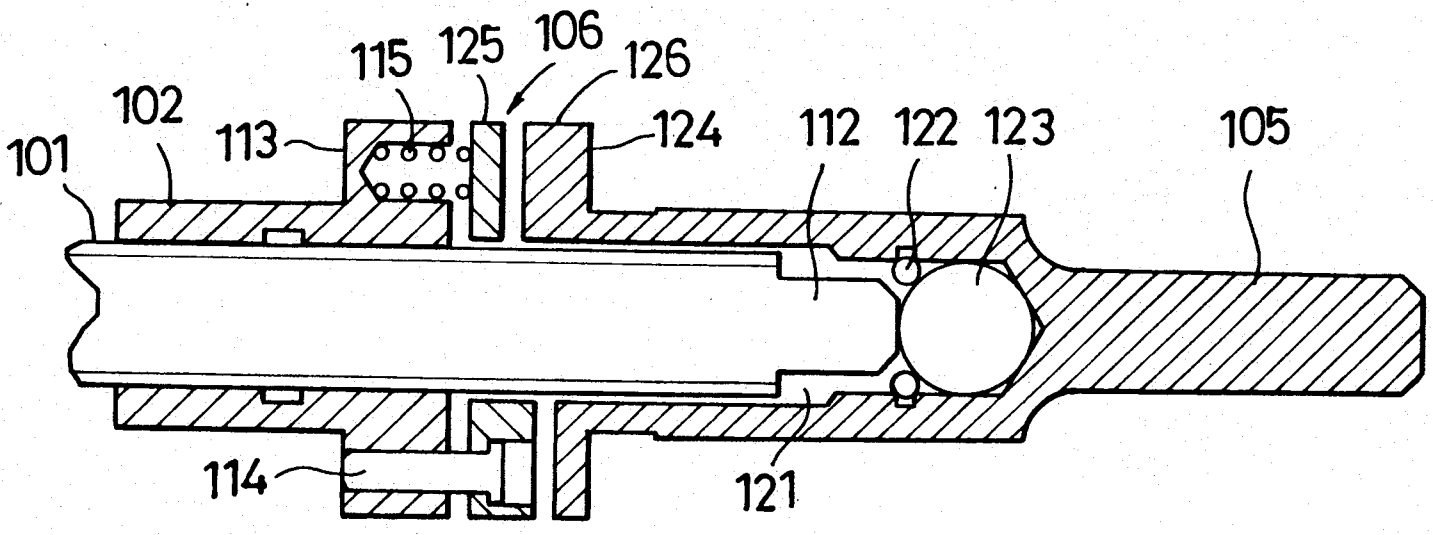
FIG. 12 is a partial front view, in longitudinal section, showing the main part of FIG. 11.
Figure 13:
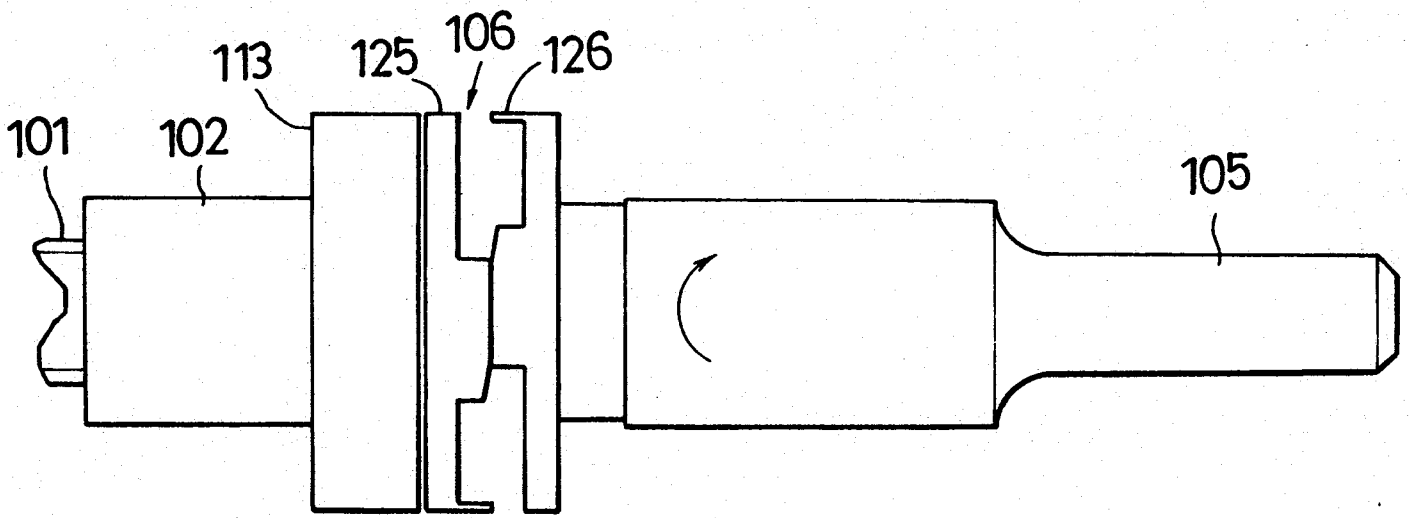
FIG. 13 is a partial front view of main parts showing the disengagement of the rear clutch mechanism.
Figure 14:
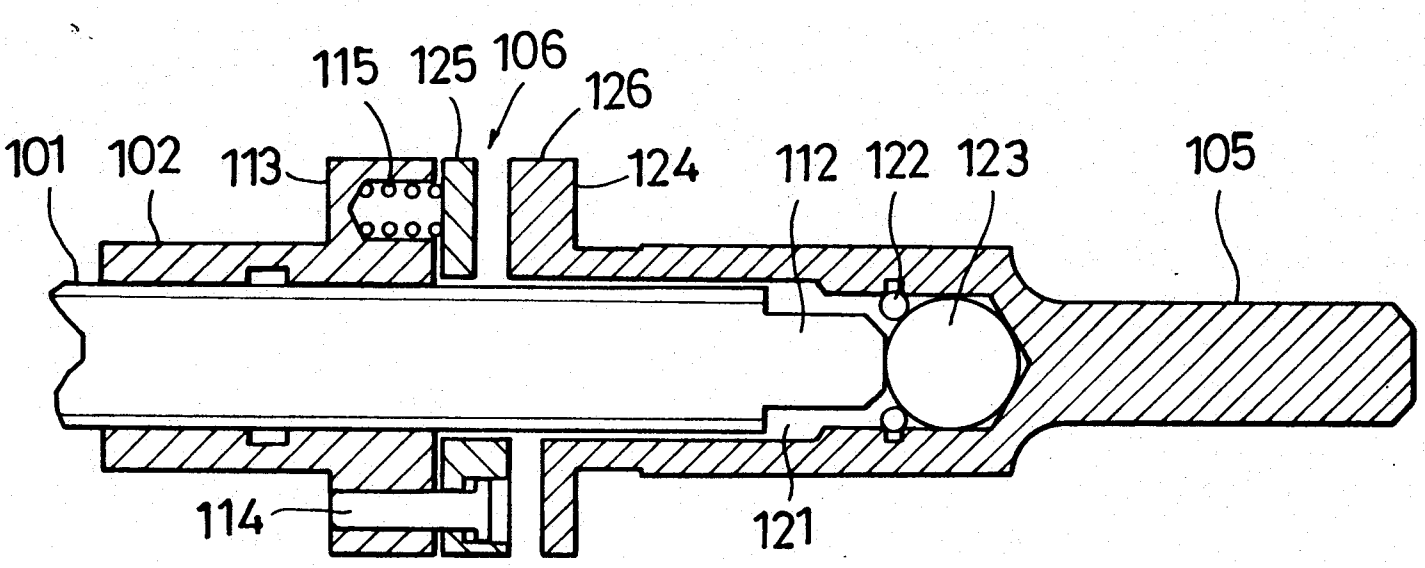
FIG. 14 is a partial front view, in longitudinal section, showing the main part of FIG. 13.

A spring member $S_2$ or a wave washer is interposed between the rear end of said rear clutch 166 and the step formed by the reduced-diameter segment 107*a* and the intermediate-diameter segment 107*b* of the journal frame 107. When there is a gap B between the step defined by the intermediate-diameter segment 107*b* and large-diameter segment 107*c* of the journal frame 107 and the main frame 108 due to manufacturing error of the rivet as shown in FIGS. 8 to 10, the biasing force of said spring member $S_2$ not only insures a relative repulsive displacement of the journal frame 107 and the main frame 108 to prevent rattling but insures smooth and positive engaging and disengaging of the forward clutch 165 and rear clutch 166 of the forward clutch mechanism 151, thus contributing to uncompromised accomplishment of the various actions mentioned hereinbefore.

Figure 8:
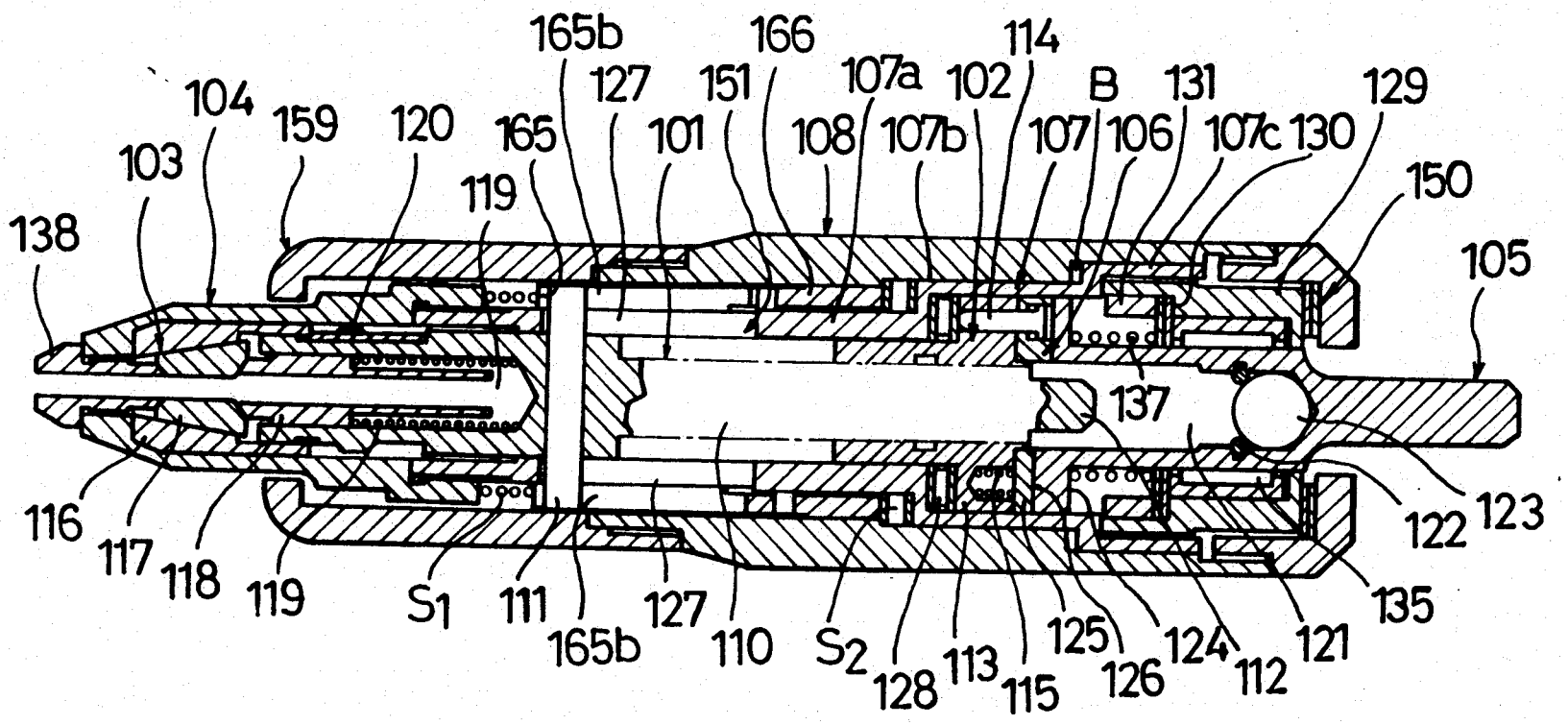
FIG. 8 is a front view, in longitudinal section, showing a second type of riveter according to the present invention.
Figure 21:
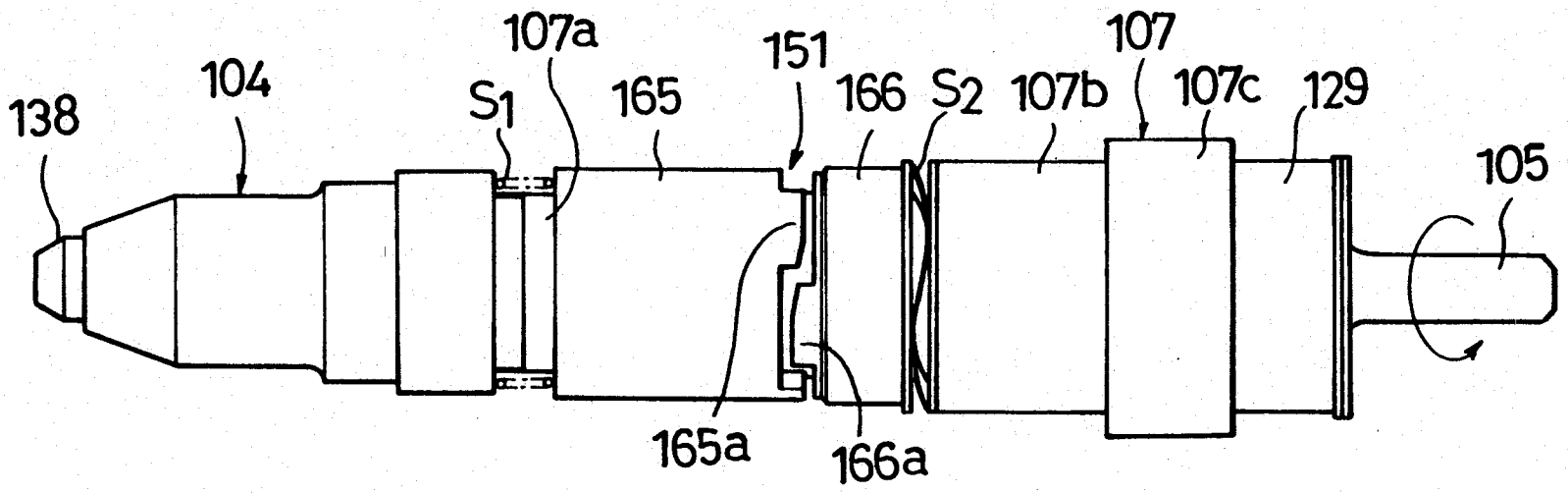
FIG. 21 is a partial front view showing the forward clutch mechanism after complete disengagement.

When the above riveter is in the condition shown in FIGS. 8 and 21, that is to say the jaw 117 of the jaw mechanism 103 is open, a blind rivet 139 having a drill point 140 at its tip is inserted into said jaw 117 and with the main frame 108 being held against rotation by hand (whereby the rear clutch 166 of the forward clutch mechanism 151 which is rigidly secured to the main frame 108 is also held stationary), the rotary drive shaft 105 is rotated slightly in the normal direction with the motor to thereby turn the rolling nut 102 in the normal direction via the rear clutch mechanism 106. Thereupon, the forward clutch 165 and rear clutch 166 of the forward clutch mechanism 151 are brought into engagement to shift the shaft 101 rearward via the slots 127,127 formed in the journal frame 107 and the turn-stop pin 111, whereby the blind rivet 139 is gripped by the jaw 117 as illustrated in FIG. 9.

This rivet gripping effect can also be accomplished as follows. Thus, as the main frame 108 is manually turned through a necessary angle clockwise as viewed from the nose piece 138, the torque of the main frame 108 is transmitted through the journal frame 107 and turn-stop pin 111 to the shaft 101 and rotates it in the same direction to thereby drive the shaft 101 rearward via the rolling nut 102 and the slots 127,127 formed in the journal frame 107.

Then, the operator relieves his hold on the main frame 108, applies the tip of the drill point 140 of the blind rivet 139 gripped by the jaw 117 against the substrate plate 141 to be riveted and rotates the rotary drive shaft 105 in the normal direction, whereby the plate 141 is drilled by the drill point 140 and, at the same time, the blind rivet 139 is fed into the drilled hole (not shown).

Figure 17:
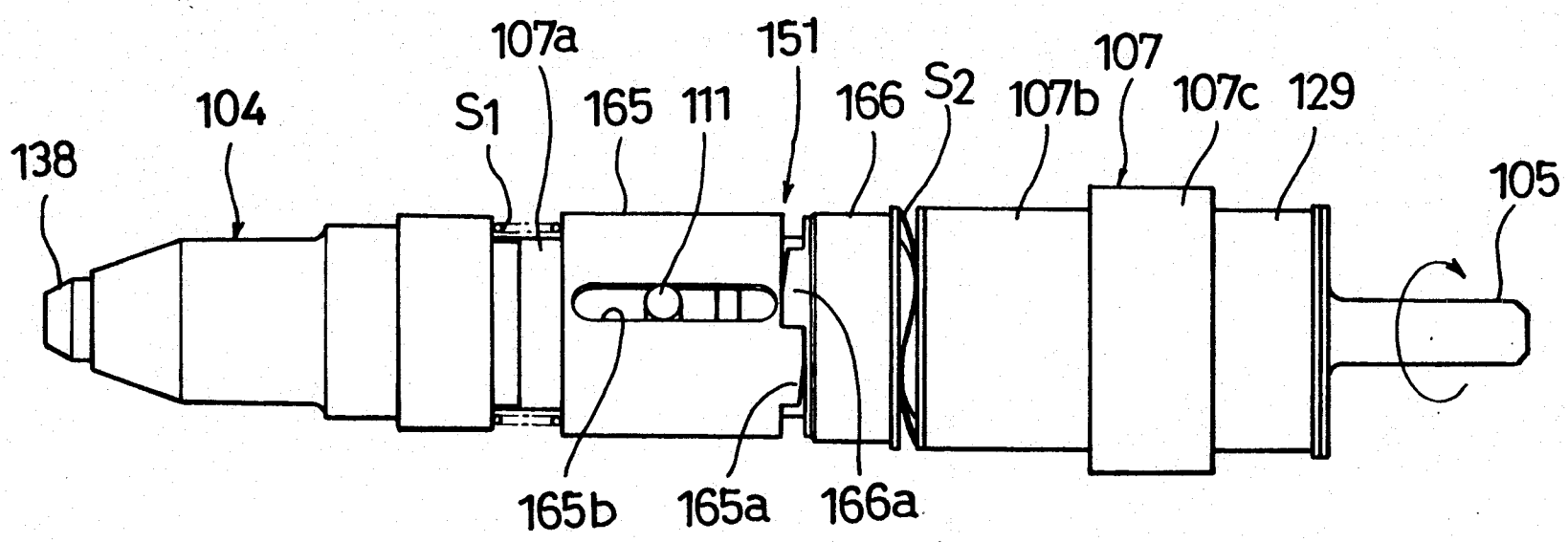
FIG. 17 is a partial front view showing the engagement of the forward clutch mechanism at riveting.

In this condition, with the main frame 108 held against rotation by hand, the rotary drive shaft 105 is turned in the normal direction. Since the forward clutch 165 of the forward clutch mechanism 151 and the rear clutch 166 rigidly secured to the main frame 108 are in engagement as shown in FIGS. 10 and 17 for setting the rivet 139, the rotation of the journal frame 107 is prevented. Therefore, the shaft 101 is driven rearward through said transmission means as illustrated in FIG. 10 to complete the riveting work.

Figure 18:
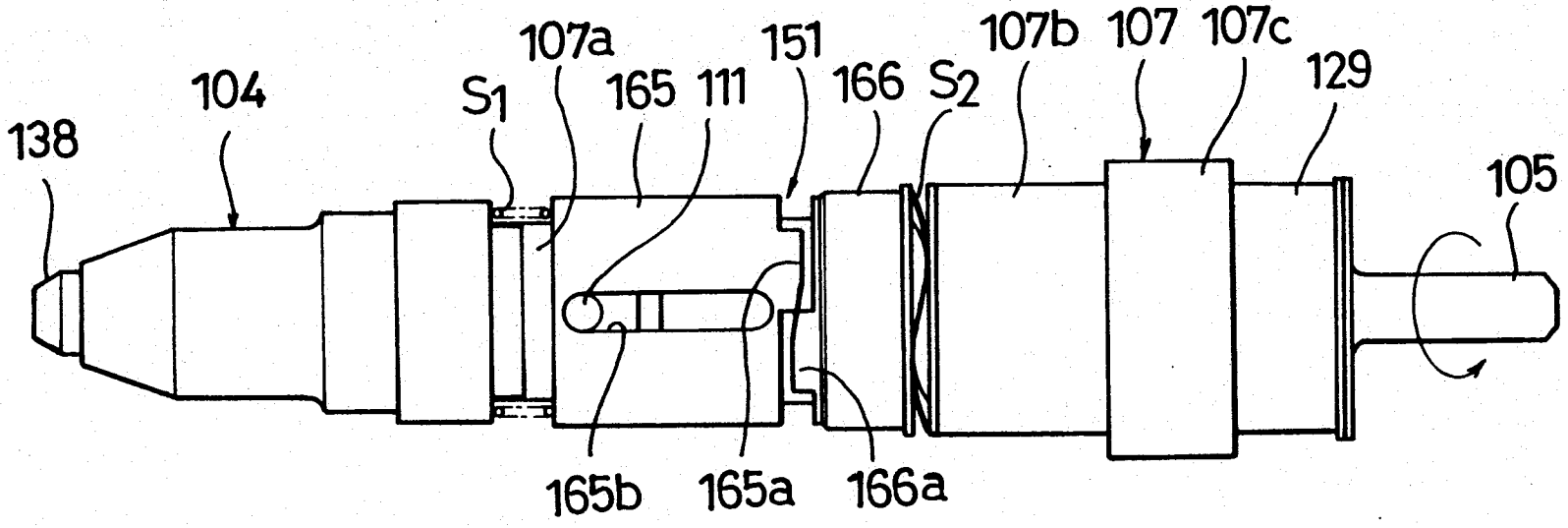
FIG. 18 is a partial front view showing the forward clutch mechanism at the beginning of disengagement immediately following ejection of the rivet shaft.
Figure 19:
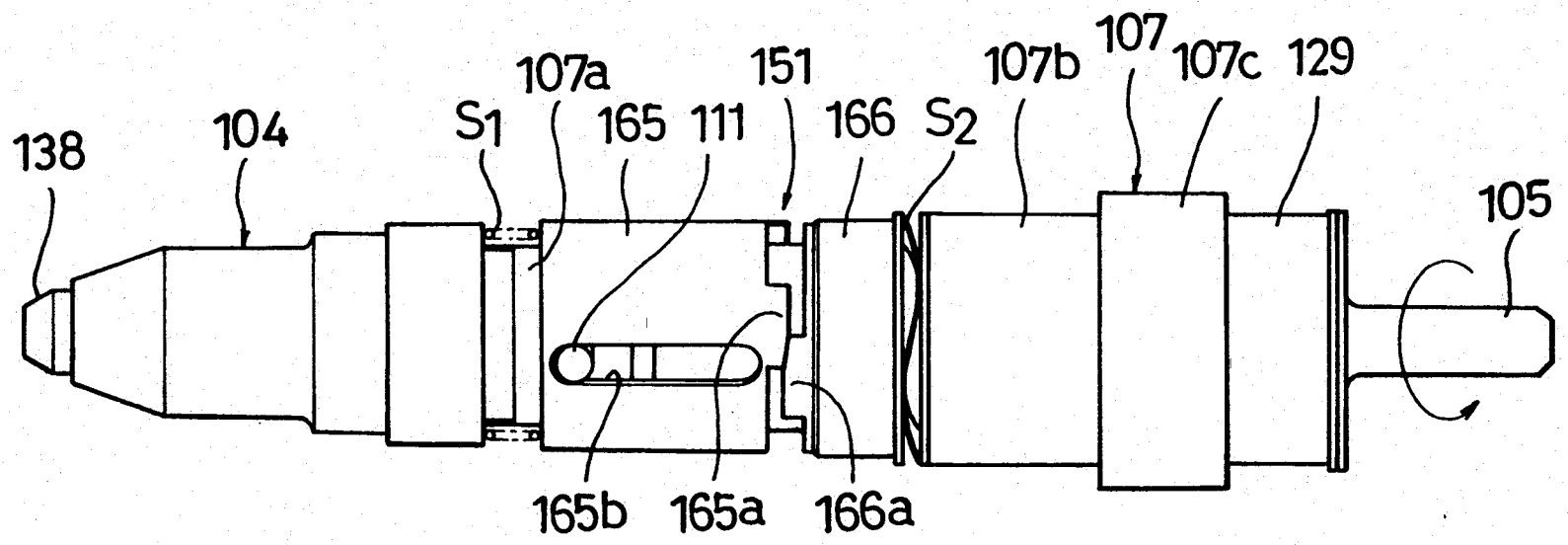
FIG. 19 is a partial front view showing the front clutch mechanism in an advanced stage of disengagement from the stage shown in FIG. 18.
Figure 20:
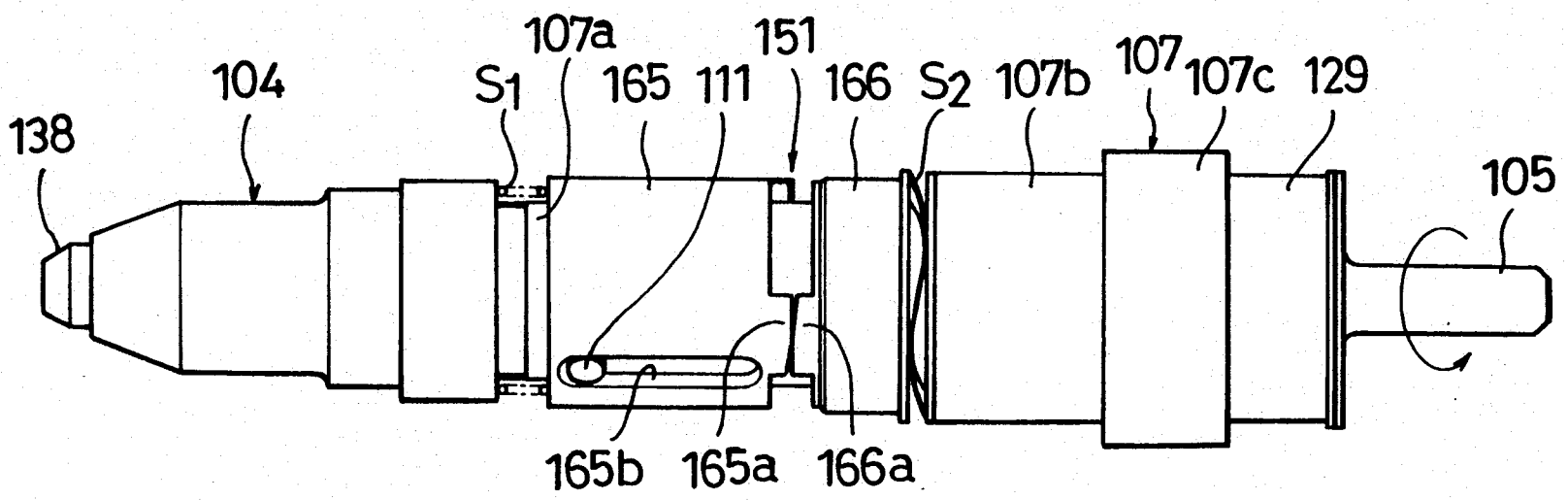
FIG. 20 is a partial front view showing the forward clutch mechanism in a further advanced stage of disengagement from the stage shown in FIG. 19.

After completion of riveting, the main frame 108 is held stationary by hand against rotating and, in this condition, the rotary drive shaft 105 is rotated in the reverse direction, whereupon the turn-stop pin 111 advances to the forward end of the slot 165 *b* in the forward clutch 165. The pin 111 then pushes the forward clutch 165 forward against the spring $S_1$ biasing the forward clutch 165 rearward to disengage the forward clutch mechanism 151 as illustrated in FIG. 18. As a result, all the members other than the front cover 159 main frame 108, rear clutch 166 and rear cover 150 are freed of restraint and become free to turn idle.

The broken rivet shaft is ejected the moment the gripping force of the jaw 117 is released and just before the restraint on rotation by the turn-stop pin 111 is released.

The action of the rear clutch mechanism 106 is now described.

Figure 15:
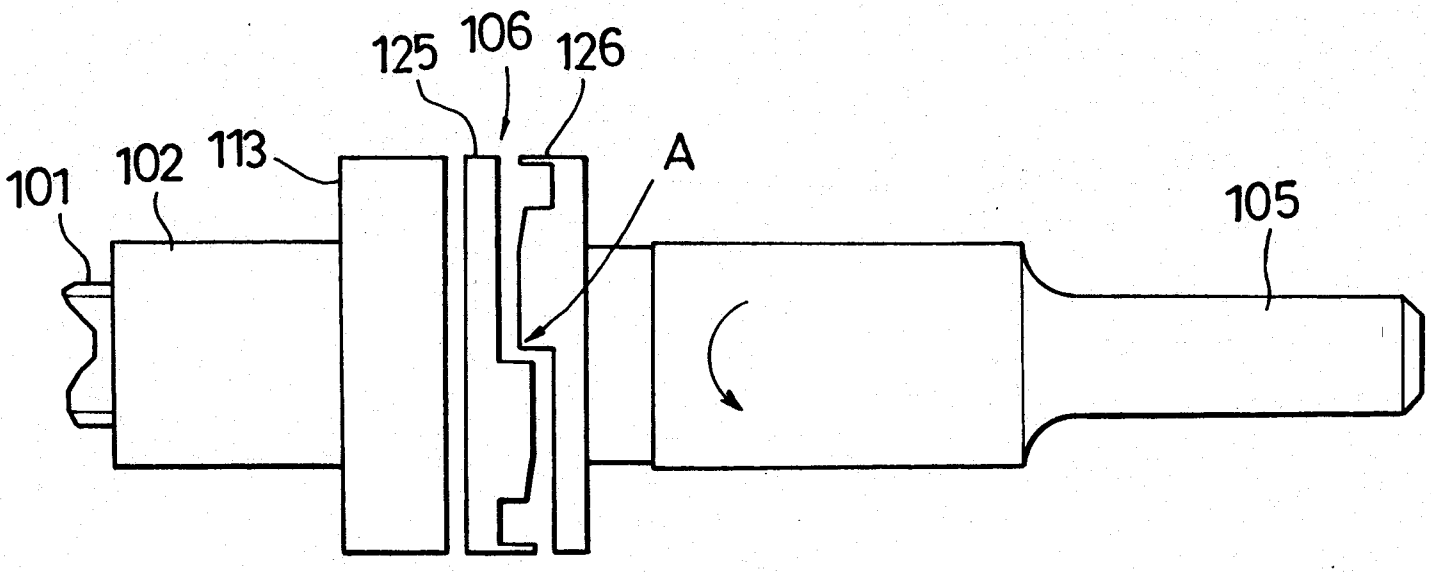
FIG. 15 is a partial front view of main parts showing the rear clutch mechanism just before engagement.
Figure 16:
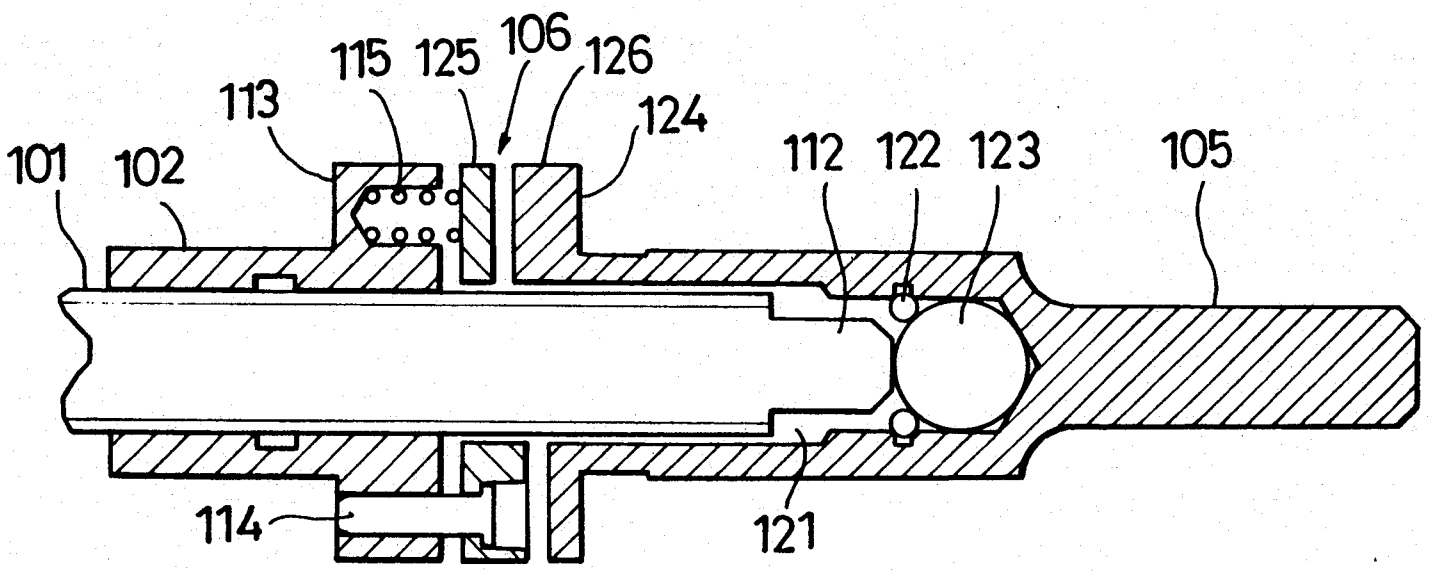
FIG. 16 is a partial front view of the main part of FIG. 15.

After the riveting work has been completed as described above, the rotary drive shaft 105 is further caused to turn in the normal direction with the main frame 108 held stationary. Then, the shaft 101 is shifted further rearward from the position indicated in FIG. 10 and its rear end hits the steel ball 123 set in the depth of the bottomed cavity 121 of the rotary drive shaft 105 to drive the rotary drive shaft 105 rearward. Thereupon, as shown in FIGS. 11 through 14 (particularly in FIGS. 11 and 12), a gap is formed between the clutch 126 on the rotary drive shaft 105 side and the movable clutch 125 and rolling nut 102 to disengage the clutches 125,126 from each other, with the result that the torque of the rotary drive shaft 105 is no longer transmitted to the movable clutch 125 and hence, the rolling nut 102 ceases to turn, thus stopping the retraction of the shaft 101.

then, when the two clutches 125,126 are in the position indicated in FIG. 15, the rotary drive shaft 105 is rotated in the reverse direction with the main frame 108 held stationary, whereupon the two clutches 125,126 are brought into engagement at A. As a result, the torque of the rotary drive shaft 105 is transmitted to the rolling nut 102 to drive the shaft 101 to the left as shown until it returns to the initial position indicated in FIG. 8, thus completing one cycle of riveting operation.

The above construction including the forward clutch 165 and rear clutch 166 of the forward clutch mechanism 151 offers the following advantage. Thus, after the riveting work is completed and the reverse rotation of the rotary drive shaft 105 has caused the shaft 101 and jaw mechanism 103 to return to the predetermined positions, these members as well as the rolling nut 102 become idling so that the front cover 159, main frame 108 and rear cover 150 are not rotated. Therefore, even if the timing of stopping the motor for driving the rotary drive shaft 105 is delayed, the risk of imposing a strong shock on the operator's hand holding the main frame 108 or other part is certainly precluded and the riveting operation can be performed smoothly and repeatedly.

Furthermore, the forward clutch mechanism 151 is so rugged in construction that the repeated engaging and disengaging cycle of the front clutch 165 and rear clutch 166 does not easily result in damage to the clutch mechanism. Therefore, the riveter of the present invention can enjoy a by far longer serviceable life than a conventional riveter and, as an additional advantage, gives no chances for misassembling.

While the present invention has been described only with reference to two embodiments, the invention is by no means limited to these specific embodiments but can be applied to an air riveter employing an air motor, to name only one example. It is, therefore, to be understood that various changes and modifications can be made by one skilled in the art without departing from the spirit and technical principles of the present invention.

What is claimed is:

1. A riveter comprising a shaft connected to a jaw mechanism at its forward end and having a rear threaded rod portion, said shaft being pierced by a turn-stop pin disposed across its axis in an appropriate intermediate position thereof and both ends of said pin protruding out of said shaft, a rolling nut threaded onto a rear end portion of said shaft, a clutch mechanism disengageably coupling said rolling nut with a rotary drive shaft, a generally cylindrical journal frame fitted over said shaft and having two juxtaposed axially elongated slots for accepting said protruding ends of the turn-stop pin of the shaft, and a cylindrical main frame fitted over and rigidly secured to said journal frame, with its forward portion covering a head frame housing the jaw mechanism, said rotary drive shaft having a bottomed cavity of required depth at its forward portion for permitting retraction of the shaft and disengaging of the clutch mechanism.

2. A riveter according to claim 1 in which said clutch mechanism comprises a clutch integrally formed on a forward end face of the rotary drive shaft and a axially movable clutch disposed on an rear face of the rolling nut.

3. A riveter according to claim 1 in which a motor reversible in the direction of rotation is employed for driving the rotary drive shaft (5).

4. A riveter comprising a shaft connected to a jaw mechanism at its forward end and having a rear threaded rod portion, said shaft being pierced by a turn-stop pin disposed across its axis in an appropriate intermediate position thereof and both ends of said pin protruding out of said shaft, a rolling nut threaded onto a rear end portion of said shaft, a rear clutch mechanism disengageably coupling said rolling nut (102) with a rotary drive shaft, a generally cylindrical journal frame fitted over said shaft and having two juxtaposed axially elongated slots for accepting said protruding ends of the turn-stop pin of the shaft, a forward clutch mechanism fitted over said journal frame, a cylindrical main frame fitted over said journal frame through interposition of said forward clutch mechanism, said forward clutch mechanism comprising a forward clutch having two juxtaposed axially elongated slots in registry with said two slots formed in said journal frame and adapted to receive both protruding ends of said turn-stop pin and rearwardly biased by a spring means and a rear clutch rigidly fitted to the main frame so that it may turn with the main frame as a unit, said rotary drive shaft shaft having a bottomed cavity of required depth at its forward portion for permitting retraction of the shaft and disengaging of the rear clutch mechanism, and the forward clutch and rear clutch of the forward clutch mechanism being engage and disengaged by the normal or reverse rotation of said rotary drive shaft.

5. A riveter according to claim 4 in which the rear clutch mechanism comprises a clutch integrally formed on a forward end face of the rotary drive shaft and an axially movable clutch disposed on a rear face of the rolling nut .

6. A riveter according to claim 4 in which the rear clutch of the forward clutch mechanism is forwardly biased, either directly or indirectly, by a spring means ($S_2$ ) disposed either directly or indirectly rearwardly thereof.

* * * * *